US011808012B2

(12) United States Patent
Pogatschnigg et al.

(10) Patent No.: US 11,808,012 B2
(45) Date of Patent: Nov. 7, 2023

(54) HYDRAULIC SYSTEM, MINING MACHINE AND METHOD OF CONTROLLING HYDRAULIC ACTUATOR

(71) Applicant: SANDVIK MINING AND CONSTRUCTION G.M.B.H., Zeltweg (AT)

(72) Inventors: Reinhold Pogatschnigg, Katsch an der Mur (AT); Christian Umundum, Spielberg (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 0 days.

(21) Appl. No.: 17/637,550

(22) PCT Filed: Aug. 27, 2019

(86) PCT No.: PCT/EP2019/072744
§ 371 (c)(1),
(2) Date: Feb. 23, 2022

(87) PCT Pub. No.: WO2021/037339
PCT Pub. Date: Mar. 4, 2021

(65) Prior Publication Data
US 2022/0290407 A1 Sep. 15, 2022

(51) Int. Cl.
*E02F 9/22* (2006.01)
*F15B 11/044* (2006.01)
(Continued)

(52) U.S. Cl.
CPC ..... *E02F 9/226* (2013.01); *E02F 9/2296* (2013.01); *E21D 9/1026* (2013.01);
(Continued)

(58) Field of Classification Search
CPC ..... F15B 11/04; F15B 11/0413; F15B 11/042; F15B 11/0445; F15B 2211/50581; F15B 2211/5059
See application file for complete search history.

(56) References Cited

U.S. PATENT DOCUMENTS 5,784,944 A * 7/1998 Tozawa ..... F15B 20/00 91/461
9,810,242 B2 * 11/2017 Wang ..... F15B 11/003
(Continued)

FOREIGN PATENT DOCUMENTS

CN 114245837 A 3/2022
EP 3159473 A1 4/2017
(Continued)

*Primary Examiner* — Michael Leslie
(74) *Attorney, Agent, or Firm* — Corinne R. Gorski

(57) ABSTRACT

A hydraulic system, mining machine and method of controlling a hydraulic actuator. The hydraulic system (HS) is provided with a control valve (23) for controlling movement direction and speed of a hydraulic actuator (HA) connected to the system. Generated force of the hydraulic actuator is controlled independently relative to the control valve by means of counterbalance valves (Cb1, Cb2) and servo valves (Sv1, Sv2) controlling their opening pressure. The counterbalance valves and the servo valves operate as a meter-out control assembly which controls flow of hydraulic fluid discharged from working pressure spaces (16*a*, 16*b*) of the hydraulic actuator. The disclosed system may be implemented to control a mining boom (3) of a mining machine (1).

15 Claims, 6 Drawing Sheets

(51) Int. Cl.

| | |
|---|---|
| ***F15B 11/04*** | (2006.01) |
| ***E21D 9/10*** | (2006.01) |
| ***F15B 11/10*** | (2006.01) |

(52) U.S. Cl.

CPC ..... *F15B 11/0413* (2013.01); *F15B 11/0445* (2013.01); *F15B 11/10* (2013.01); *F15B 2211/20546* (2013.01); *F15B 2211/5059* (2013.01); *F15B 2211/50581* (2013.01); *F15B 2211/6313* (2013.01); *F15B 2211/7053* (2013.01)

(56) References Cited

U.S. PATENT DOCUMENTS

| | | | | |
|---|---|---|---|---|
| 10,316,929 | B2 * | 6/2019 | Wang | B66C 13/066 |
| 10,323,663 | B2 * | 6/2019 | Wang | F16K 31/426 |
| 10,344,783 | B2 * | 7/2019 | Wang | B66C 13/066 |
| 11,028,862 | B2 * | 6/2021 | Pogatschnigg | E02F 9/2285 |
| 11,204,048 | B2 * | 12/2021 | Yuan | E04G 21/0454 |
| 11,209,028 | B2 * | 12/2021 | Yuan | F15B 13/01 |
| 2019/0136875 | A1 | 5/2019 | Lacher | |

FOREIGN PATENT DOCUMENTS

| | | | |
|---|---|---|---|
| RU | 2150553 | C1 | 6/2000 |
| RU | 2617019 | C2 | 4/2017 |
| RU | 2621408 | C2 | 6/2017 |
| WO | 2016011193 | A1 | 1/2016 |
| WO | 2018153477 | A1 | 8/2018 |

* cited by examiner

HYDRAULIC SYSTEM, MINING MACHINE AND METHOD OF CONTROLLING HYDRAULIC ACTUATOR

RELATED APPLICATION DATA

This application is a § 371 National Stage Application of PCT International Application No. PCT/EP2019/072744 filed Aug. 27, 2019.

BACKGROUND OF THE INVENTION

The invention relates to a hydraulic system intended to operate and control a hydraulic actuator which is connected to the system. The hydraulic system is intended for a mining machine.

Meter in and out control systems have been used for hydraulic control of actuators of heavy machinery that act on excavation buckets, loader front ends and the like mechanical arms of mobile machines. The system receives pressurized hydraulic fluid from a pump and is coupled in fluid communication with a hydraulic load actuator such as a hydraulic cylinder that is mechanically linked to a mechanical actuator or device. However, the known hydraulic systems offer limited possibilities to control operation of the hydraulic actuator. This in turn limits the range of functionality of the machines.

BRIEF DESCRIPTION OF THE INVENTION

An object of the invention is to provide a novel and improved hydraulic system for controlling operation of a hydraulic actuator. The invention further relates to a novel and improved mining machine and to a method of controlling operation of a hydraulic actuator.

An idea of the disclosed solution is that the hydraulic system is provided with a control valve for controlling movement direction and speed of a hydraulic actuator connected to the system. Generated force of the hydraulic actuator is controlled independently relative to the control valve by means of counterbalance valves and solenoid valves controlling opening pressure of the counterbalance valves. Then the counterbalance valves and the solenoid valves operate as a meter-out control assembly which controls flow of hydraulic fluid discharged from working pressure spaces of the hydraulic actuator.

In other words, the disclosed hydraulic system to control the hydraulic actuator is provided with a meter-out control system comprising a metering control valve assembly wherein the meter-out counterbalance valves are pressure controlled by means of the solenoid valves.

An advantage of the disclosed solution is that more versatile control of a hydraulic actuator is provided when it is controlled by means of the disclosed hydraulic system. The disclosed solution allows independent control of movement direction, force and movement speed for the actuator. These independently controllable features allow more effective and accurate control for the specific actuator and thereby allow increasing productivity and user-friendliness of the machine.

The present solution is based on meter out control, wherein the counterbalance valves are actively controlled by means of the solenoid valves.

Further, the disclosed solution implements simple and well proven hydraulic components, whereby it is reliable and inexpensive.

In this document the mining machine means also machines intended for tunneling.

According to an embodiment, the control valve is configured to control the hydraulic fluid flow and the counterbalance valves are configured to control the hydraulic pressure. The control valve and the counterbalance valves are separately controlled whereby the hydraulic system is provided with independent control of force and speed of the hydraulic actuator. In other words, the first and second solenoids allow pressure of the discharged fluid to be controlled independently relative to the control valve. Thus, the first and second control valves together with the first and second counterbalance valves form meter-out assemblies dedicated to control the discharged pressures, whereas the control valve is dedicated to control flow of hydraulic fluid fed to actuator and also direction of movement of the actuator. The disclosed pressure control affects to the generated forces whereas the flow control affects to the generated movement speeds. The achieved independent control allows more versatile control of the actuator.

The hydraulic pressure in the working pressure spaces affects on the effective forces of the hydraulic actuator as well as on stiffness and overall response on changing loads of the actuator.

According to an embodiment, the first and second solenoid valves are electrically controlled valves. Then the first and second solenoid valves are controlled by means of one or more control units. The control unit may generate electrical control signals in response to received control commands and input data. The control unit may be a computer comprising a processor or it may be a programmable logic controller (PLC), for example. The control unit may be located onboard the mobile machine or it may be an external device which communicates with the solenoids valves via a data communication path.

According to an embodiment, the mentioned control unit controlling the solenoid valves is configured to set constant opening pressure for the first and second solenoid valves. The setting is adjustable by an operator via a user interface of the control unit. Thus, the operator may select desired opening pressures according to the need.

According to an embodiment, the control unit is provided with sensing data on operation of the hydraulic actuator and is configured to adjust the opening pressure setting in response to the received sensing data. Then the implemented meter out control ensures accurate static and moving positional control in response to external static and dynamic load forces.

According to an embodiment, the hydraulic system may further comprise pressure sensor for operating pressures in pressure spaces of the hydraulic actuator. The sensing data of the pressure sensors is transmitted to the control unit for controlling the first and second solenoid valves in response to the sensed pressures. An advantage of this solution is that when the pressures of the hydraulic cylinder are sensed, the control unit is able to control the solenoid valves accurately so that desired pressure levels are reached. This kind of feedback control allows use of different accurate pressure settings and different control modes for the hydraulic actuator. The sensed pressure data may be transmitted to the control unit via a data communication connection, which may or may not implement wireless data transmission.

The disclosed meter-out system of the hydraulic circuit is configured to control the hydraulic actuator to provide accurate movement and static positioning both when the actuator is not externally loaded and also in response to external static and dynamic loads. The disclosed hydraulic system is adapted for variation of speed of actuation and the force with which the actuation is provided. The hydraulic actuator, controlled by means of the disclosed meter-out system, may be maintained in a relatively stiff configuration so as to be capable of withstanding significant external forces.

According to an embodiment, the mentioned control valve is a proportional directional valve and is pressure controlled and may be pilot pressure controlled or direct solenoid controlled. Then the hydraulic system comprises a third solenoid valve configured to control movement of the control valve in a first operational direction, and comprises a fourth solenoid valve configured to control the movement in an opposite second operational direction. Thus, not only the operation of the first and second counterbalance valves but also operation of the control valve are all pressure controlled by means of the several solenoid valves. The use of such pressure control is especially advantageous when flame proof system is required, which is the case for example in coal mines. In such circumstances the hydraulic circuit may only comprise approved components. In the present circuit can be used basic hydraulic components which already have the needed approvals for the flame proof systems. Further, the disclosed solenoid control of the control valve is advantageous because there are no reliable and quickly operating other type control valves available.

According to an embodiment, the hydraulic actuator connected to the hydraulic system is a hydraulic cylinder.

According to an embodiment, the hydraulic cylinder has a double piston configuration and is thereby provided with two pistons and a piston rod mounted between the pistons. Then diameters of the working pressure spaces have equal dimensions, whereby forces in both movement directions are equal when the same pressure is fed to the working pressure spaces.

According to an alternative embodiment, a normal or conventional type hydraulic cylinder is used as a hydraulic actuator. In such conventional differential cylinder sizes of effective piston areas in opposite directions are different and needs to be taken into account in the control. This embodiment is an alternative to the above mentioned double piston cylinder.

According to an alternative embodiment, the hydraulic actuator is a hydraulic motor. The hydraulic motor may be connected to a transmission or gear system for transmitting the mechanical power to a boom or corresponding mechanical actuator or device.

According to an embodiment, the hydraulic pump of the hydraulic circuit is a variable displacement pump. Then the produced flow rate can be adjusted according to the need. The variable displacement pump may be controlled by means of the mentioned control unit, whereby desired fluid flow may be under direct control of the control unit. Alternatively, the variable displacement pump may be controlled by means of a Load Sensing control system. The LS-control system may sense the prevailing pressure in the hydraulic system and the generated LS-signal may control the pump.

According to an embodiment, the hydraulic pump is a fixed displacement pump. This kind of pump is simple, inexpensive and reliable.

According to an embodiment, the hydraulic system further comprises two additional counterbalance valves. One additional counterbalance valve is connected to a first control pressure line between the first solenoid valve and the first counterbalance valve, and another additional counterbalance valve is connected to a second control pressure line between the second solenoid valve and the second counterbalance valve. Nominal flow directions of the additional counterbalance valves are opposite to nominal flow directions of the basic counterbalance valves of the meter-out system. The additional counterbalance valves may be used in applications wherein pulling forces may be generated under operation to the hydraulic actuators configured to generate pushing forces. Thus, the additional counterbalance valves are intended for preventing problems in the control caused by the pulling forces. The additional counterbalance valves have pre-set opening pressures and when the pressure decreases below the set value, then the counterbalance valve closes and prevents control pressure flow from the solenoid valve to the basic counterbalance valves, whereby the basic counterbalance valves decrease or prevent hydraulic fluid form the hydraulic actuator. The additional counterbalance valves may act as simple pressure controlled ON/OFF valves between the solenoid valves and the basic counterbalance valves.

According to an embodiment, the disclosed hydraulic system comprises a control mode wherein the first and second solenoid valves are inoperative and thereby do not provide control for the counterbalance valves. Then the counterbalance valves are controlled by pressure acting in the first and second pressure conduits. The first and second counterbalance valves are provided with basic opening pressure settings and when the pressure in the first and second pressure conduits exceeds the basic opening pressure setting then the counterbalance valves open. In this embodiment, the hydraulic circuit is provided with two alternative control principles for controlling the counterbalance valves and thereby it further increases different possibilities for arranging the control of the hydraulic actuator. The operator may switch the solenoids valves into inoperative state.

According to an embodiment, the disclosed solution relates to a mobile mining machine. The mining machine comprises a movable carrier and one or more mining booms connected movably on the carrier. The mining boom is provided with a mining unit mounted at a free end of the boom. The boom is moved by means of one or more hydraulic boom actuators and the actuator is connected to a hydraulic system for providing needed hydraulic power. The hydraulic system for controlling at least one of the boom actuators is in accordance with the system disclosed in this document.

According to an embodiment, the mining boom can be moved horizontally in lateral direction and also vertically. However, highest forces are typically generated in the lateral direction of the boom, at least when the mining is based on cutting method. Also highest accuracy requirements exist in the lateral direction.

According to an embodiment, the hydraulic boom actuator is a hydraulic cylinder configured to turn the mining boom relative to the carrier. As already mentioned above, the mining boom can be moved laterally and vertically and may thereby comprise several cylinders each of them provided with the similar control system. Then speed and forces of the boom in several directions of movement can be controlled properly.

According to an embodiment, the mining machine is an undercutting mining machine provided with a cutting boom. The mining unit mounted to the cutting boom comprises at least one rotatable cutting head provided with several cutting tools. The undercutting machines are used when tunneling and extracting.

According to an embodiment, the hydraulic system of undercutting mining machine comprises modes of operation including at least a cutting mode, positioning mode and profiling mode. In the cutting mode the cutting boom is moved horizontally with a nominal speed optimized for the given cutter head and material being cut. Aim of the cutting mode is to cut the material as effectively as possible. In the positioning mode the cutting head is moved by means of the cutting boom to a specific position. Aim of the positioning mode is to reach the desired position as fast as possible. In the profiling mode the cutting face on the borders is finalized in order to get the intended profile for the tunnel. Aim of the profiling mode is to cut this intended profile as fast (but not with real fast movement) and accurate as possible in order to improve quality of the cut surface and to save concrete in the further working steps, for example. Each mode may comprise dedicated opening pressure value for controlling opening of the counterbalance valves and dedicated parameters for controlling the control valve and the generated fluid flow. For example, in the cutting mode great forces are directed to the cutting boom whereby it needs to relative stiff. Thereby, relative high values are implemented as opening pressure values for the counterbalance valves. On the other hand, movement speed of the cutting boom is slow in the cutting mode, whereby magnitude of the fluid flow through the control valve may be small. In the positioning mode no significant forces are directed to the cutting boom whereby the pressure setting for the counterbalance valves may be low. High speed of movement is needed whereby the control valve needs to allow great fluid to the actuator. In the profiling mode semi high speed of movement and forces occur whereby the control parameters for controlling the opening pressure and the fluid flow may be somewhere between the other two modes. The main idea is to have the option to optimize the control system for different modes and operational requirements and to set parameters for obtaining desired force and speed.

According to an embodiment, the disclosed solution relates to a method of controlling a hydraulic actuator. The method comprises: generating hydraulic pressure and flow by means of a hydraulic pump to a hydraulic system; directing selectively hydraulic fluid flow from the pump to working pressure spaces of the hydraulic actuator and correspondingly discharging the hydraulic fluid from the working spaces to a tank by means of a control valve; and restricting the fluid flow discharged from the working pressure spaces by means of dedicated counterbalance valves. The method further comprises adjusting opening pressure of the mentioned counterbalance valves by means of separate solenoid valves and thereby providing the hydraulic actuator with adjustable force control being independently controllable relative to the control valve.

According to an embodiment, the method comprises adjusting hydraulic fluid flow and pressure affecting in the working pressure spaces independently relative to each other, whereby movement speed and generated force are also independently controlled.

According to an embodiment, the method comprises controlling the solenoid valves by means of electrical control signals generated by means of a control unit. Hydraulic control signals are generated by means of the mentioned solenoid valves for hydraulically controlling the counterbalance valves.

The above disclosed embodiments and features may be combined in order to form suitable solutions having those of the above features that are needed.

BRIEF DESCRIPTION OF THE FIGURES

Some embodiments are described in more detail in the accompanying drawings, in which

FIGS. 5 and 6 are combined with the basic system of FIG. 4.

For the sake of clarity, the figures show some embodiments of the disclosed solution in a simplified manner. In the figures, like reference numerals identify like elements.

DETAILED DESCRIPTION OF SOME EMBODIMENTS

Figure 1:
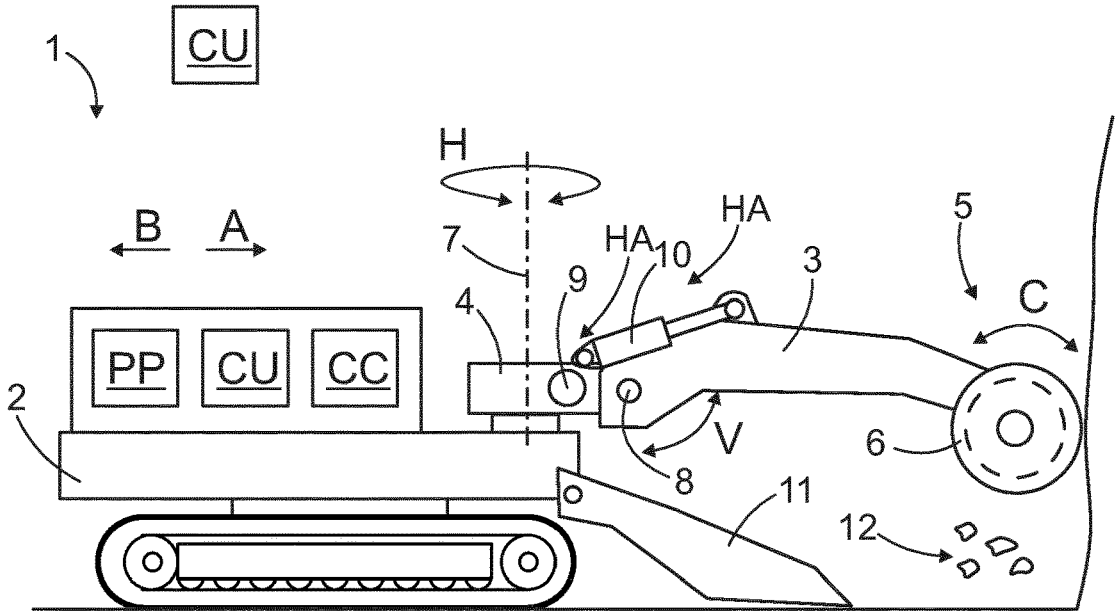
FIG. 1 is a schematic side view of a mining machine intended for undercutting process.

FIG. 1 shows a mining machine 1 intended for undercutting. The mining machine 1 comprises a movable carrier 2 and a mining boom 3 connected to the carrier 2 by means of a turret or turning table 4. The mining boom 3 comprises a mining unit 5 at a distal end of the boom 2. The mining unit 5 comprises one or more rotatable C cutting heads 6 each provided with several cutting tools, which are not shown in detail. The mining boom 2 may be moved horizontally H by turning the turning table 4 around vertical turning axis 7. The mining boom 3 may also be moved vertically V relative to a joint 8. The horizontal movement H may be executed by means of a first boom actuator 9 and the vertical movement may be executed by means of a second boom actuator 10. The boom actuators 9 and 10 may be hydraulic cylinders which are powered by means of a hydraulic power pack PP. The mining machine 1 can be moved forwards A and can be reversed B. At a front end of the mining machine 1 may be a collecting device 11 for receiving material 12 excavated by means of the cutting unit 5. The mining machine 1 comprises at least one on-board control unit CU which may be is data communication with one or more external control unit CU. On the carrier 2 may or may not be a control cabin CC for an operator.

Figure 2:
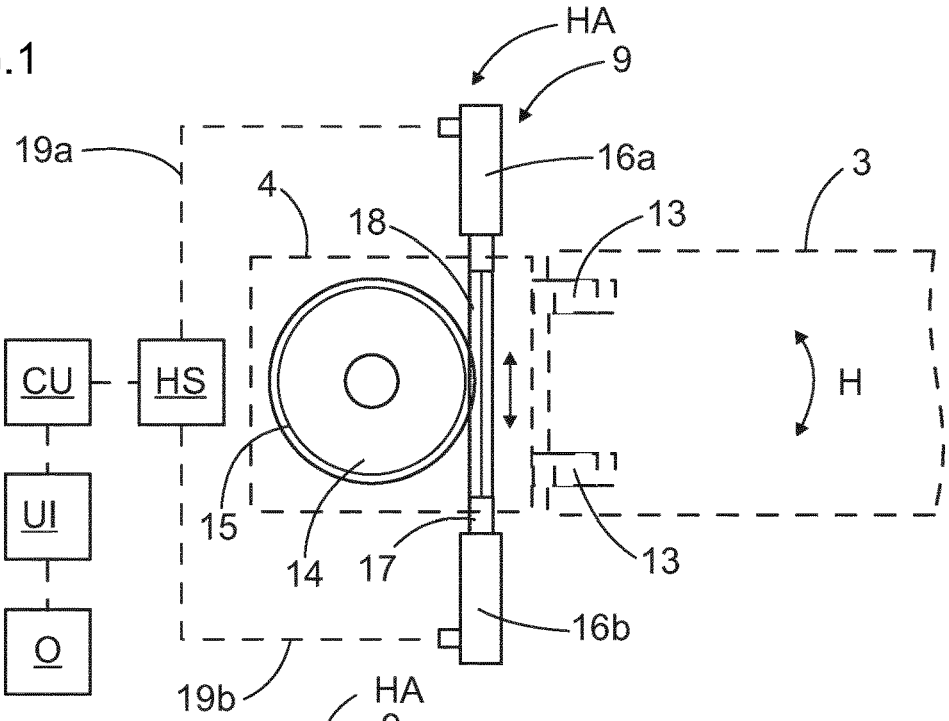
FIG. 2 is a schematic top view of a hydraulic double piston cylinder arranged to turn a boom in a horizontal direction.

FIG. 2 is a highly simplified figure showing a system for turning a mining boom 3 horizontally H. The boom 2 is mounted to connecting flanges 13 of a turning table 4 shown in broken lines for clarity reasons. The turning table 4 is turned relative to a support element 14 provided with a toothed rim 15. A hydraulic boom actuator 9 is a cylinder mounted horizontally and comprising two pistons and working pressure spaces 16*a*, 16*b* whereby a piston rod 17 is located between the working pressure spaces 16*a*, 16*b*. The piston rod 17 is provided with a toothed outer surface 18 matching with the toothed rim 15. When the piston rod 17 is moved the turning table and the connected mining boom 3 turn horizontally H. The boom cylinder 9 is connected to a hydraulic circuit HS by means of pressure conduits 19*a* and 19*b*. Further, the hydraulic circuit HS may communicate with one or more control units CU. An operator O may communicate with the control unit CU via a user interface.

The operator O may make selections, feed control parameters and make control commands for influencing control of the boom 3.

Figure 3:
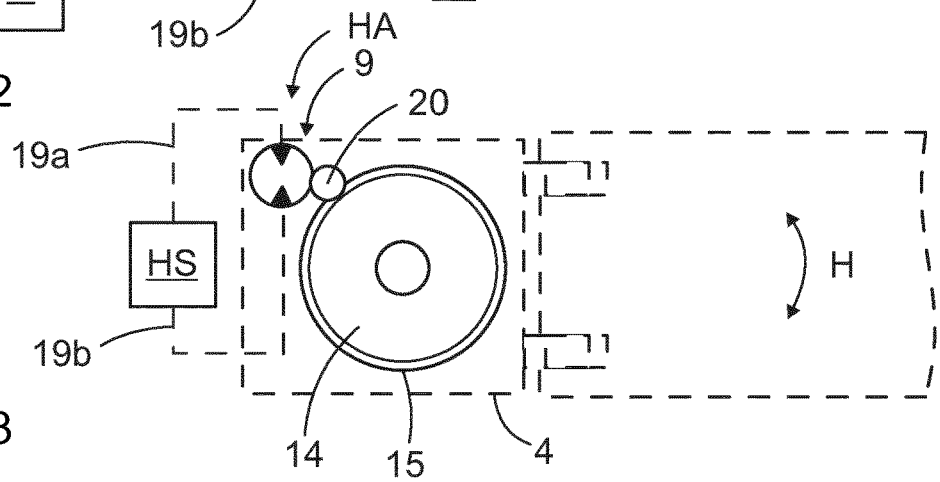
FIG. 3 is a schematic top view of an alternative solution which utilizes a hydraulic motor for turning a boom.

FIG. 3 discloses another solution for turning a turning table 4 and a mining boom 3. The solution differs from the one shown in FIG. 2 in that the hydraulic cylinder is substituted by a hydraulic motor. So in this case the hydraulic boom actuator 9 is a hydraulic motor which is arranged to cause horizontal boom movement. The hydraulic motor may be connected to a gear or other transmission element 20 in order to transmit generated rotation movement to a toothed outer rim 15 of a support element 14. Working pressure space of the hydraulic motor are connected to a hydraulic circuit HS by means of pressure conduits 19*a* and 19*b*.

The hydraulic cylinders and motors 9, 10 shown in FIGS. 1 and 2 are hydraulic actuators HA which may be controlled in accordance to principles disclosed in this document.

Figure 4:
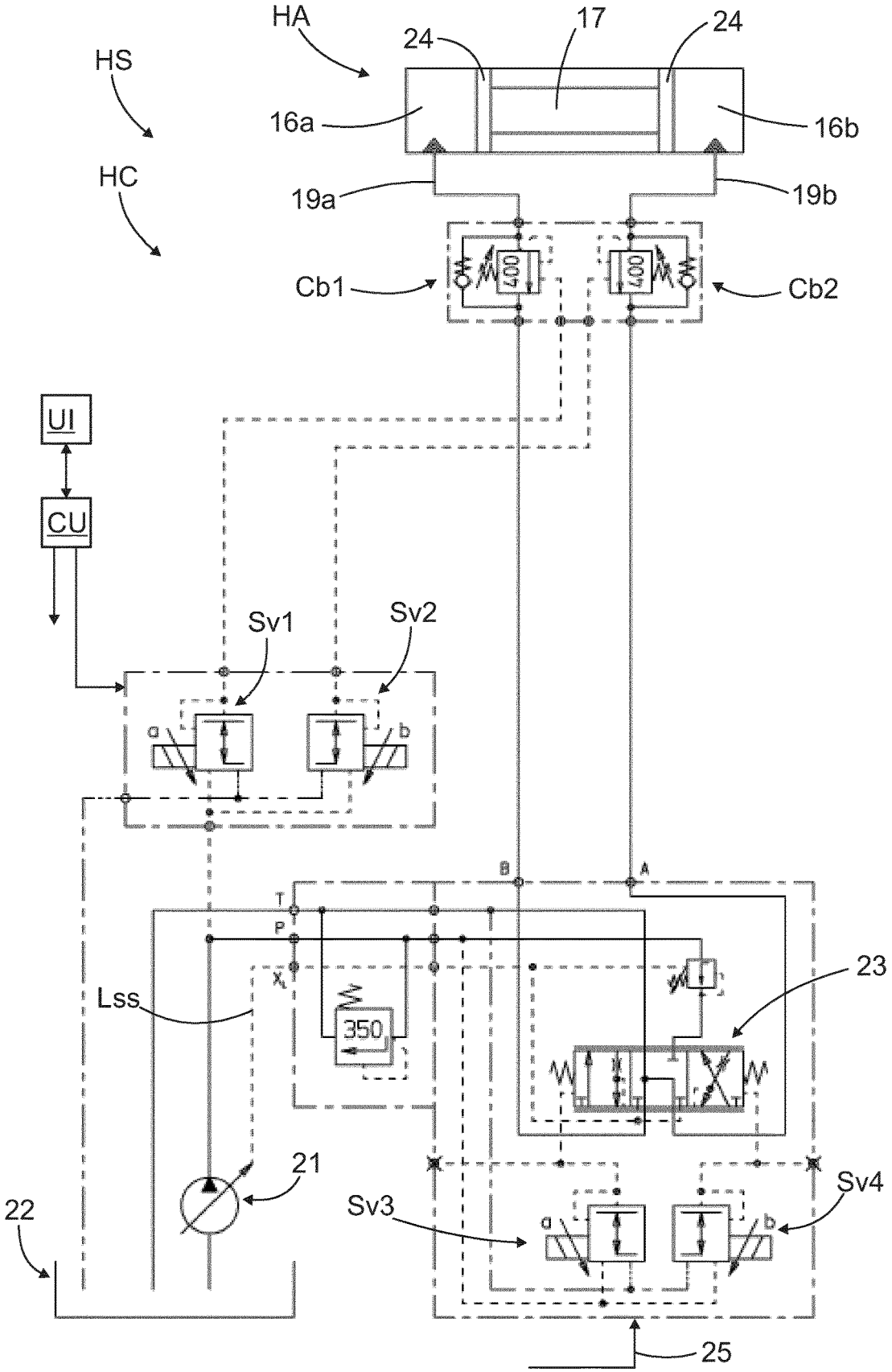
FIG. 4 is a schematic view of a first hydraulic circuit configured to provide needed hydraulic power to a hydraulic actuator and for controlling its operation.

FIG. 4 discloses a hydraulic circuit HC of a hydraulic system HS. The system comprises a hydraulic actuator HA, a pump 21, a tank 22, a control valve 23 and needed pressure conduits. The hydraulic actuator HA may be a hydraulic cylinder having a double piston configuration whereby it has two pistons 24 and a piston rod 17 between them. The cylinder also has two working pressure spaces, namely a first working pressure space 16*a* with a first pressure conduit 19*a*, and a second working pressure space 16*b* with a second pressure conduit 19*b*. The cylinder may correspond to the one shown in FIG. 2. A first counterbalance valve Cb1 is connected to the first pressure conduit 19*a* for controlling pressure fluid discharged from the first working pressure space 16*a*, and a second counterbalance valve Cb2 is connected to the second pressure conduit 19*b* for controlling pressure fluid discharged from the second working pressure space 16*b*. The counterbalance valves Cb1 and Cb2 allow pressure fluid to flow freely towards the working pressure spaces 16*a*, 16*b* but they restrict flow out of the working pressure spaces 16*a*, 16*b*. The counterbalance valves Cb1, Cb2 are provided with basic opening pressure setting, for example 400 bar, and their opening pressure setting may be adjusted to be lower than the basic setting by means of solenoid valves Sv1 and Sv2. A first solenoid valve Sv1 provides pressure control for the first counter balance valve Cb1 and a second solenoid valve Sv2 provides pressure control for the second counterbalance valve Cb2. By adjusting the opening pressure of the counterbalance valves Cb1 and Cb2 pressure prevailing in the working pressure spaces may be adjusted allowing thereby controlling force generated by the hydraulic actuator HA. The solenoid valves Sv1 and Sv2 are electrically controlled valves and can be controlled by means of electrical control signals generated by means of a control unit CU. An operator may feed control data and commands by means of a user interface UI for the control unit CU. The solenoid valves Sv1 and Sv2 can be controlled independently by means of the control unit CU.

The control valve 23 is configured to control movement direction of the hydraulic actuator HA. The control valve 23 may be a proportional directional valve as shown in FIG. 1. When the control valve 23 moves from its middle position to left direction, then pressure fluid flow generated by the pump 21 is directed through the control valve 23 to the first working pressure space 16*a* of the hydraulic actuator HA and correspondingly fluid is discharged from the second working pressure space 16*b*. Then the piston rod 17 moves to left. When the control valve 23 moves from the middle position to right direction then the fluid flow is directed to the second working pressure space and the first working pressure space is discharged causing the piston rod to move to right. Since the control valve is a proportional valve, magnitude of the movement in either direction adjust magnitude of fluid flow passing through the control valve whereby the control valve adjusts fluid and also generated speed of movement of the hydraulic actuator HA. As can be noted, the control valve 23 may be hydraulically pilot controlled, or directly solenoid controlled. An electrically controlled third solenoid valve SV3 produces pressure control for moving the control valve 23 to right and an electrically controlled fourth solenoid valve SV4 produces pressure control for moving the control valve 23 to left. The solenoid valves Sv3 and Sv4 may provide electrical control signals 25 from the control unit CU.

FIG. 4 further disclose that the pump 21 may be a variable displacement pump and may be controlled by a load sense signal Lss.

Figure 5:
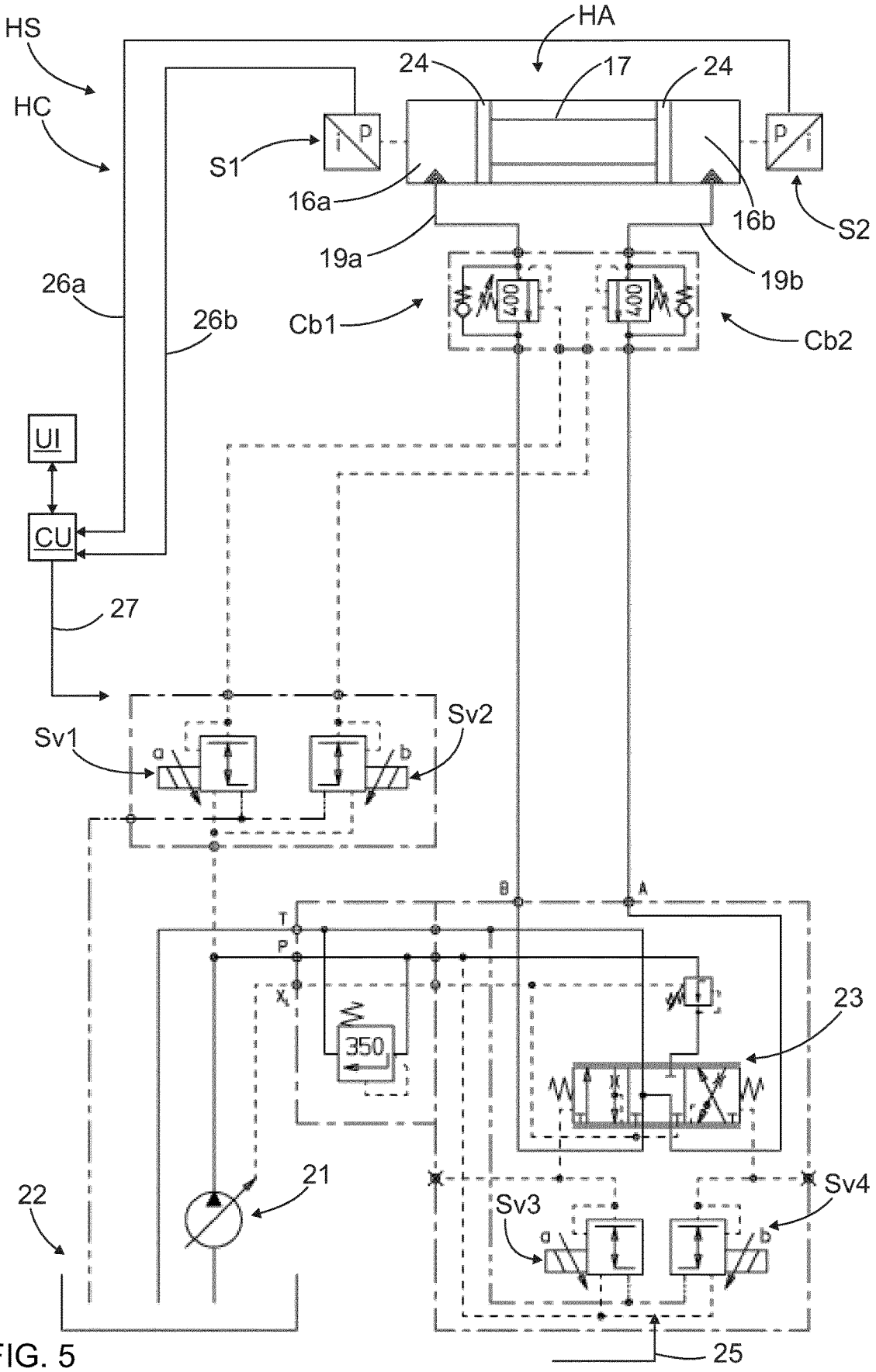
FIG. 5 is a schematic view of a second hydraulic circuit wherein pressure prevailing inside a hydraulic actuator is detected.

FIG. 5 discloses a hydraulic system HS which substantially corresponds to the one shown in FIG. 4. However, pressures prevailing in the working pressure spaces 16*a*, 16*b* are sensed by means of a first pressure sensor S1 and a second pressure sensor S2. The produced sensing data is transmitted to a control unit CU via data transmission paths 26*a* and 26*b*. Then the control unit CU is able to take the received pressure data into account and send control signals via a data transmission path 27 to servo valves Sv1 and Sv2.

Figure 6:
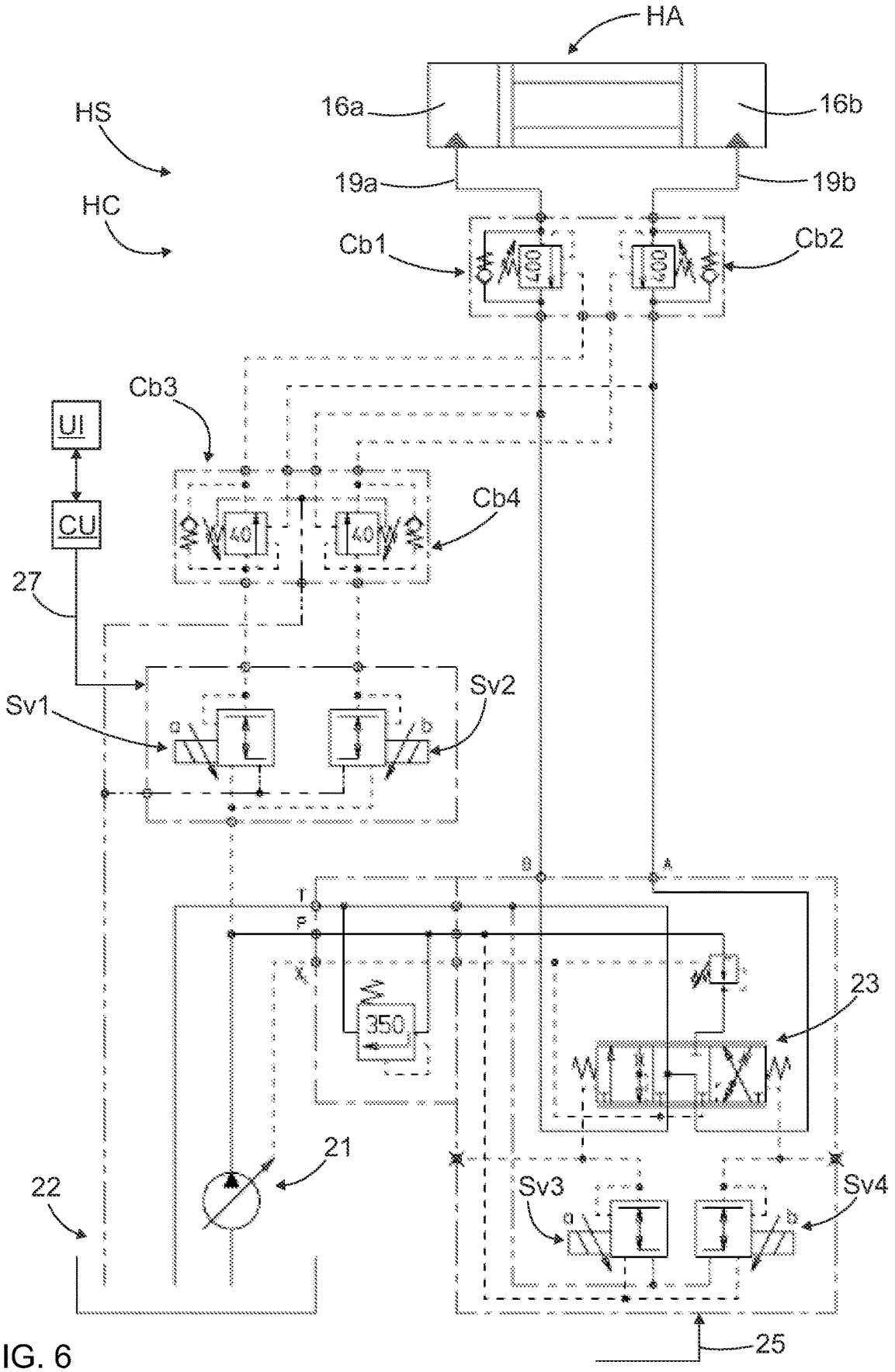
FIG. 6 is a schematic view of a third hydraulic circuit wherein additional counterbalance valves are utilized.

FIG. 6 discloses a hydraulic system HS basic configuration of which corresponds to the system disclosed in FIG. 4. The present solution differs from the basic solution in that there are two additional counterbalance valves Cb3 and Cb4 series corrected with main counterbalance valves Cb1 and Cb2. Then a first additional counterbalance valve Cb3 is mounted between a first counterbalance valve Cb1 and a first solenoid valve Sv1, and correspondingly, a second additional counterbalance valve Cb4 is mounted between a second counterbalance valve Cb2 and a second solenoid valve Sv2. As can be noted, nominal operating direction of the additional counterbalance valves Cb3 and Cb4 is opposite to nominal operating direction of the main counterbalance valves Cb1 and Cb2. Further, pressure setting of the additional counterbalance valves Cb3, Cb4 is significantly lower as pressure setting of the main counterbalance valves Cb1, Cb2. As it is disclosed earlier in this document, the additional counterbalance valves Cb3 and Cb4 are used for special use cases wherein external pulling forces may be directed to the hydraulic actuator. The pulling may hamper proper controlling of the system and the use of the additional counterbalance valves Cb3, Cb4 eliminates the undesired effects of the pulling.

Figure 7:
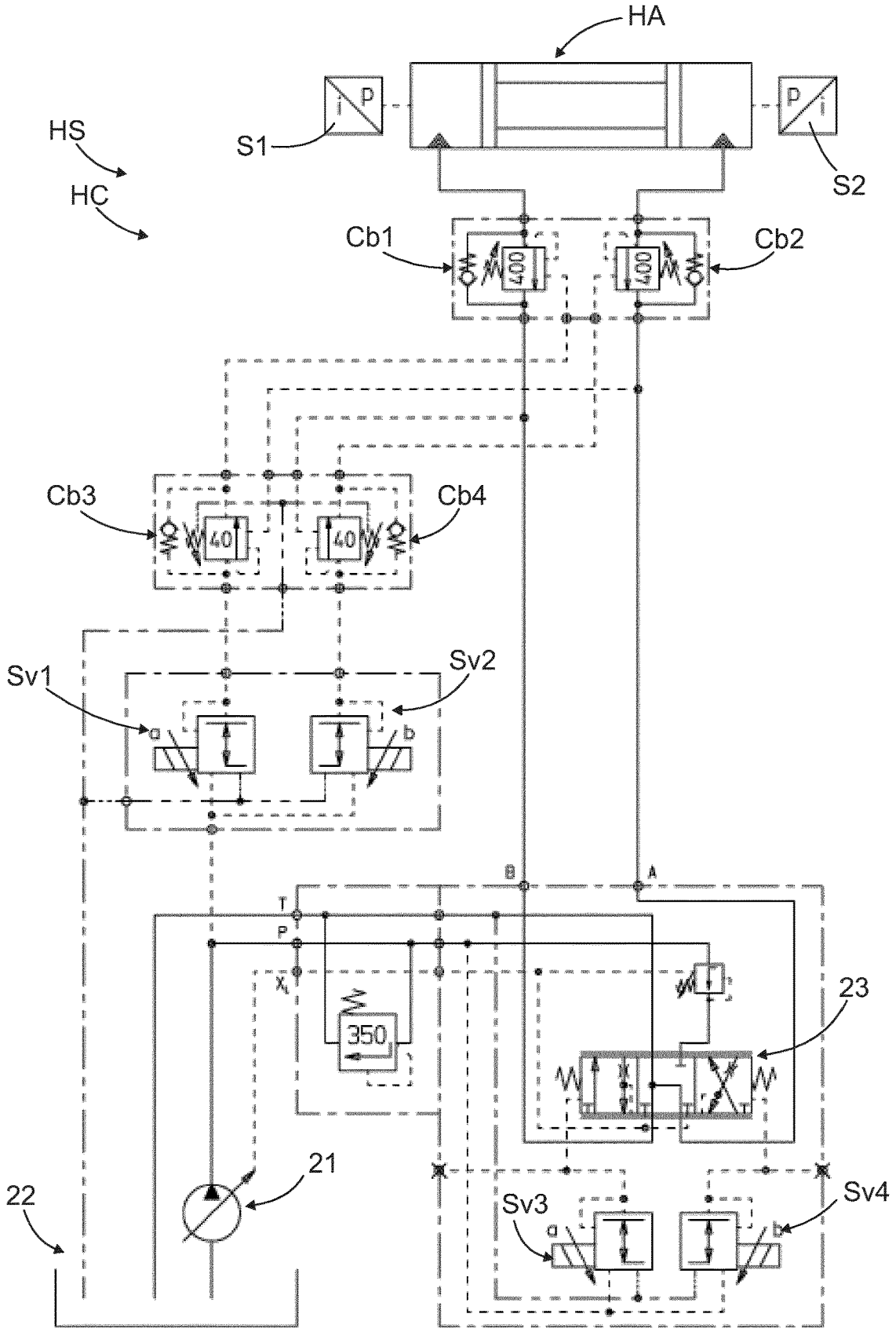
FIG. 7 is a schematic view of a fourth hydraulic circuit wherein additional features of previous

FIG. 7 discloses a hydraulic system HS which comprises a combination of features disclosed in connection with FIGS. 4 to 6. Therefore, there is no need to provide detailed disclosure of the system shown in FIG. 7. The disclosed control features may be selective activated whereby a versatile and well adjustable system is provided.

Let it be mentioned that the hydraulic systems and circuits presented in FIGS. 4-7 are suitable also for controlling normal hydraulic cylinders with one single piston, and also for controlling hydraulic motors. The disclosed solution suits well for controlling different boom actuators but may also be used for controlling other mechanical arms and structures of different kind of excavating and tunnelling machines.

The basic pressure setting values disclosed in connection with the counterbalance valves are only examples and can be selected case by case.

Figure 8:
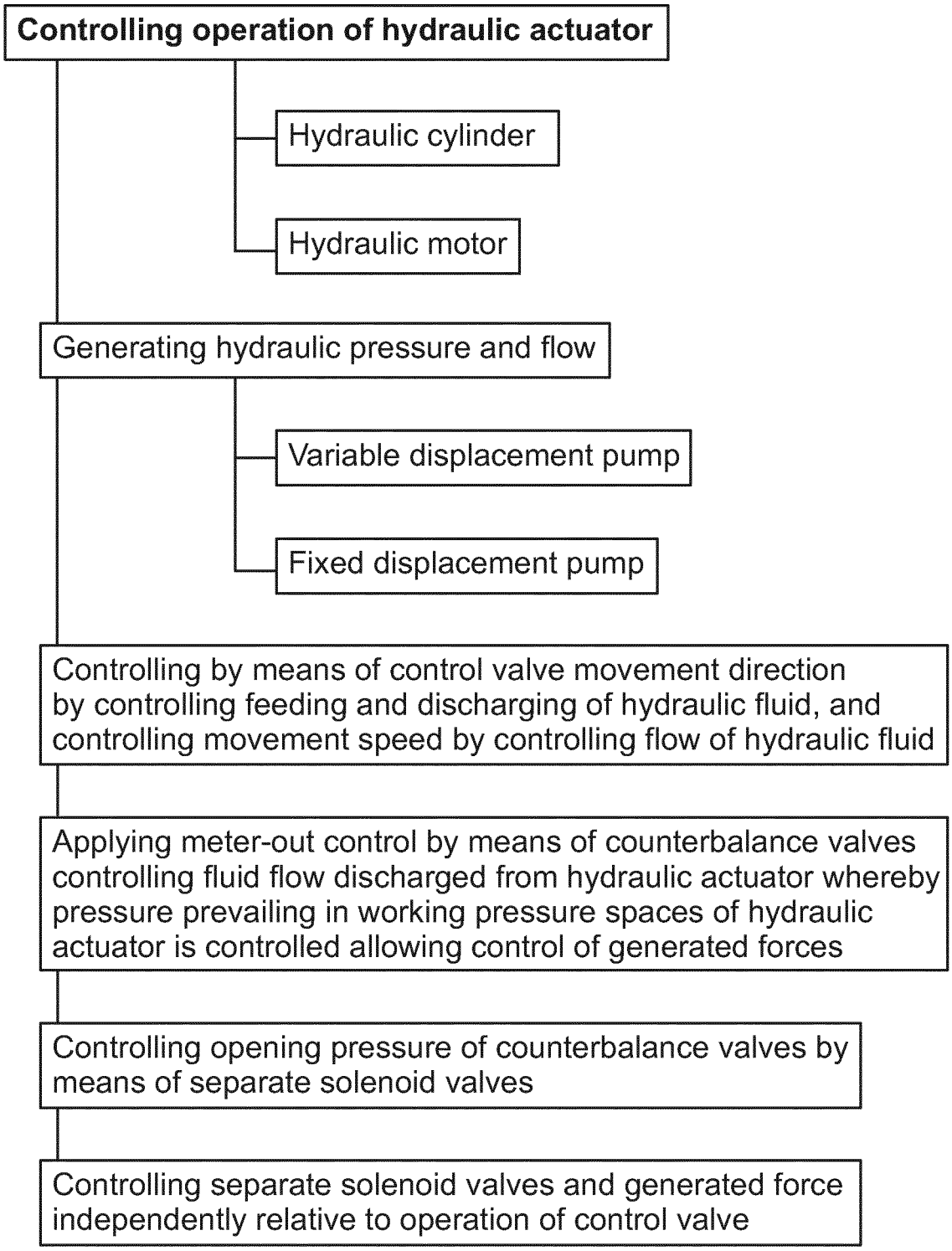
FIG. 8 is a diagram showing some principles and features relating to the disclosed method.

FIG. 8 discloses features that have already been discussed above in this document.

The drawings and the related description are only intended to illustrate the idea of the invention. In its details, the invention may vary within the scope of the claims.

The invention claimed is:

1. A hydraulic system for a mining machine comprising:

a pump for producing hydraulic pressure and flow to the system;

a tank for storing and receiving hydraulic fluid;

a hydraulic actuator including a first working pressure space and a second working pressure space;

a first pressure conduit being in fluid connection with the first working pressure space and a second pressure conduit being in fluid connection with the second working pressure space;

a first counterbalance valve connected to the first pressure conduit and configured to restrict discharged fluid flow out of the first working pressure space and allowing free input flow into an opposite direction;

a second counterbalance valve connected to the second pressure conduit and configured to restrict discharged fluid flow out of the second working pressure space and allowing free input flow into an opposite direction;

a control valve arranged for controlling feeding and discharging of hydraulic fluid to and from the first and second working pressure spaces in order to control direction and speed of movement generated by the hydraulic actuator; and a first solenoid valve arranged for controlling opening pressure of the first counterbalance valve and a second solenoid valve arranged for controlling opening pressure of the second counterbalance valve, whereby pressure of the hydraulic fluid discharging from the working pressure spaces of the hydraulic actuator is independently controllable.

2. The hydraulic system as claimed in claim 1, wherein the control valve is configured to control the hydraulic fluid flow affecting to generated movement speed of the hydraulic actuator and the counterbalance valves are configured to control the hydraulic pressure affecting to generated force of the hydraulic actuator whereby the hydraulic system is provided with independent control of force and speed of the hydraulic actuator.

3. The hydraulic system as claimed in claim 1, wherein the first and second solenoid valves are electrically controlled valves and the first and second solenoid valves are controlled by means of at least one control unit.

4. The hydraulic system as claimed in claim 3, further comprising a first pressure sensor for sensing the pressure acting in the first pressure space, a second pressure sensor for sensing the pressure acting in the second pressure space, wherein sensing data of the pressure sensors is transmitted to the control unit for controlling the first and second solenoid valves in response to the sensed pressures.

5. The hydraulic system as claimed in claim 1, wherein the control valve is a proportional directional valve, and wherein a third solenoid valve is configured to control movement of the control valve in a first operational direction and a fourth solenoid valve is configured to control the movement in an opposite second operational direction.

6. The hydraulic system as claimed in claim 1, wherein the hydraulic actuator connected to the hydraulic system is a hydraulic cylinder.

7. The hydraulic system as claimed in claim 1, wherein the hydraulic pump is a variable displacement pump.

8. The hydraulic system as claimed in claim 1, further comprising a third counterbalance valve connected to a first control pressure line between the first solenoid valve and the first counterbalance valve, and a fourth counterbalance valve connected to a second control pressure line between the second solenoid valve and the second counterbalance valve, wherein nominal flow directions of the third and fourth counterbalance valves is opposite to nominal flow directions of the first and second counterbalance valves.

9. The hydraulic system as claimed in claim 1, further comprising a control mode wherein the first and second solenoid valves are inoperative and the first and second counterbalance valves are controlled by pressure acting in the first and second pressure conduits.

10. A mining machine comprising:

a movable carrier;

at least one mining boom connected movably to the carrier;

a mining unit mounted at a distal end of the mining boom;

at least one hydraulic boom actuator for moving the mining boom relative to the carrier and being connected to the hydraulic system; and a hydraulic system as claimed in claim 1 arranged for providing hydraulic power and for controlling the boom actuator.

11. The mining machine as claimed in claim 10, wherein the hydraulic boom actuator is a hydraulic cylinder configured to turn the mining boom relative to the carrier.

12. The mining machine as claimed in claim 10, wherein the mining machine is an undercutting mining machine provided with a cutting boom, and the mining unit mounted to the cutting boom includes at least one rotatable cutting head provided with several cutting tools.

13. A method of controlling a hydraulic actuator, the method comprising:

generating hydraulic pressure and flow by means of a hydraulic pump to a hydraulic system;

directing selectively hydraulic fluid flow from the pump to working pressure spaces of the hydraulic actuator and correspondingly discharging the hydraulic fluid from the working spaces to a tank by means of a control valve;

restricting the fluid flow discharged from the working pressure spaces by means of dedicated counterbalance valves; and adjusting opening pressure of the counterbalance valves by means of separate solenoid valves and thereby providing the hydraulic actuator with adjustable force control being independently controllable relative to the control valve.

14. The method as claimed in claim 13, further comprising adjusting hydraulic fluid flow and pressure affecting in the working pressure spaces independently relative to each other, whereby movement speed and generated force are also independently controlled.

15. The method as claimed in claim 13, further comprising controlling the solenoid valves by means of electrical control signals generated by means of a control unit, and generating hydraulic control signals by means of the solenoid valves for hydraulically controlling the counterbalance valves.

* * * * *